US011742121B2

(12) United States Patent
Sakazaki

(10) Patent No.: US 11,742,121 B2
(45) Date of Patent: Aug. 29, 2023

(54) SM—FE—N MAGNET MATERIAL AND SM—FE—N BONDED MAGNET

(71) Applicant: DAIDO STEEL CO., LTD., Nagoya (JP)

(72) Inventor: Iwao Sakazaki, Nagoya (JP)

(73) Assignee: DAIDO STEEL CO., LTD., Nagoya (JP)

( * ) Notice: Subject to any disclaimer, the term of this patent is extended or adjusted under 35 U.S.C. 154(b) by 48 days.

(21) Appl. No.: 16/285,490

(22) Filed: Feb. 26, 2019

(65) Prior Publication Data

US 2019/0267165 A1 Aug. 29, 2019

(30) Foreign Application Priority Data

Feb. 28, 2018 (JP) ..... 2018-034276

(51) Int. Cl.

| | |
|---|---|
| ***H01F 1/059*** | (2006.01) |
| ***C22C 38/00*** | (2006.01) |
| ***C22C 38/02*** | (2006.01) |
| ***C22C 38/06*** | (2006.01) |
| ***C22C 38/10*** | (2006.01) |
| ***C22C 38/14*** | (2006.01) |
| ***H01F 1/055*** | (2006.01) |

(52) U.S. Cl.

CPC ..... *H01F 1/059* (2013.01); *C22C 38/001* (2013.01); *C22C 38/005* (2013.01); *C22C 38/02* (2013.01); *C22C 38/06* (2013.01); *C22C 38/10* (2013.01); *C22C 38/14* (2013.01); *H01F 1/0558* (2013.01); *C22C 2202/02* (2013.01)

(58) Field of Classification Search

CPC ..... H01F 1/059; H01F 1/0558; C22C 38/001; C22C 38/005; C22C 38/02; C22C 38/06; C22C 38/10; C22C 38/14

USPC ..... 252/62.54

See application file for complete search history.

(56) References Cited

U.S. PATENT DOCUMENTS

| | | | |
|---|---|---|---|
| 5,482,573 | A | 1/1996 | Sakurada et al. |
| 5,750,044 | A | 5/1998 | Yoneyama et al. |
| 5,916,376 | A | 6/1999 | Fukuno et al. |

(Continued)

FOREIGN PATENT DOCUMENTS

| | | | |
|---|---|---|---|
| CN | 1205109 | A | 1/1999 |
| CN | 1326200 | A | 12/2001 |

(Continued)

OTHER PUBLICATIONS

Ryo Omatsuzawa, Kimitoshi Murashige, and Takahiko Iryama, "Structure and Magnetic Properties of SmFeN Prepared by Rapid-Quenching Method", Denki-Seiko (Electric Furnace Steel), Daido Steel Co., Ltd., vol. 73, No. 4, pp. 235-242, published in Oct. 2002.

(Continued)

*Primary Examiner* — Humera N. Sheikh
*Assistant Examiner* — Katherine A Christy
(74) *Attorney, Agent, or Firm* — McGinn I.P. Law Group, PLLC

(57) ABSTRACT

An Sm—Fe—N magnet material includes from 7.0 at % to 12 at % of Sm, from 0.1 at % to 1.5 at % of at least one element selected from the group consisting of Hf and Zr, from 0.05 at % to 0.5 at % of C, from 10 at % to 20 at % of N, and from 0 at % to 35 at % of Co, with a remainder being Fe and unavoidable impurities.

14 Claims, 4 Drawing Sheets

(56) References Cited

U.S. PATENT DOCUMENTS

| | | | | |
|---|---|---|---|---|
| 5,968,290 | A * | 10/1999 | Sakurada | H01F 1/059 148/301 |
| 2001/0054453 | A1 | 12/2001 | Sakurada et al. | |
| 2002/0014283 | A1 | 2/2002 | Iriyama et al. | |
| 2004/0144450 | A1* | 7/2004 | Iriyama | C04B 35/58042 148/105 |
| 2013/0020527 | A1 | 1/2013 | Li et al. | |
| 2015/0318089 | A1 | 11/2015 | Li et al. | |

FOREIGN PATENT DOCUMENTS

| | | | |
|---|---|---|---|
| CN | 101546642 | A | 9/2009 |
| CN | 102403078 | A | 4/2012 |
| CN | 103531321 | A | 1/2014 |
| CN | 105355354 | A | 2/2016 |
| CN | 105825989 | A | 8/2016 |
| CN | 104823249 | B | 1/2018 |
| EP | 3 121 822 | A1 | 1/2017 |
| JP | H04-241402 | A | 8/1992 |
| JP | H 06-172936 | A | 6/1994 |
| JP | H10-312918 | A | 11/1998 |
| JP | 2001-167915 | A | 6/2001 |
| JP | 2002-057017 | A | 2/2002 |
| JP | 2004-063666 | A | 2/2004 |
| JP | 2008-258463 | A | 10/2008 |
| JP | 2013-531359 | A | 8/2013 |
| JP | 2016-526298 | A | 9/2016 |
| KR | 10-2015-0095714 | A | 8/2015 |

OTHER PUBLICATIONS

Chinese Office Action, dated Apr. 27, 2020, in Chinese Application No. 201910148189.1 and English Translation thereof.

Korean Office Action, dated Apr. 3, 2020, in Korean Application No. 10-2019-0023324 and English Translation thereof.

Extended European Search Report dated Jul. 24, 2019 for European Patent Application No. 19159952.1-1212.

Korean Office Action, dated Sep. 18, 2020, in Korean Application No. 10-2019-0023324 and English Translation thereof.

Chinese Office Action, dated Mar. 8, 2021, in Chinese Patent Application No. 201910148189.1 and English Translation thereof.

F. Kawashima, et al., "Magnetic properties and microstructure of rapidly quenched SmZrFeCoN magnets" »IEEE Transactions on Magnetics« vol. 35, No. 5, 3289-3291, Sep. 1999.

Japanese Office Action, dated Nov. 16, 2021, in Japanese Application No. 2018-034276 and English Translation thereof.

European Office Action, dated Nov. 22, 2021, in European Application No. 19 159 952.1-1212.

European Office Action, dated Apr. 24, 2023, in European Application No. 19 159 952.1.

* cited by examiner

○ Example of present invention
● Comparative example

SM—FE—N MAGNET MATERIAL AND SM—FE—N BONDED MAGNET

FIELD OF THE INVENTION

The present invention relates to an Sm—Fe—N(samarium-iron-nitrogen) magnet material and an isotropic Sm—Fe—N bonded magnet suitable for use in applications where a small size, a small thickness, or a complicated shape is required.

BACKGROUND OF THE INVENTION

At present, an Nd—Fe—B (neodymium-iron-boron) magnet is mainly used as a permanent magnet for applications where high magnetic force (maximum energy product) is required, but an Sm—Fe—N magnet including Sm, Fe and N is known as a magnet having properties surpassing the Nd—Fe—B magnet (Patent Document 1 and Non-Patent Document 1). Here, a part of Fe may be replaced with Co (cobalt). The Sm—Fe—N magnet is featured by saturation magnetic polarization comparable to the Nd—Fe—B magnet, higher anisotropic magnetic field and Curie temperature than the Nd—Fe—B magnet, and resistance to oxidation and rusting.

In general, powders used as the raw material of a sintered magnet or bonded magnet are classified by magnetism into an isotropic magnet powder and an anisotropic magnet powder. The "isotropic magnet powder" as used herein indicates a powder in which each individual powder particle is formed from a large number of fine crystal grains and easy magnetization directions of respective crystal grains are randomized. On the other hand, the "anisotropic magnet powder" indicates a powder in which each individual powder particle is one single crystal or even when each individual powder particle is formed from a large number of fine crystal grains, easy magnetization directions of respective crystal grains are aligned in a specific direction. The Sm—Fe—N powder includes mainly an isotropic powder in which the main phase thereof is a hexagonal crystal structure that is metastable and called a $TbCu_7$ type (for example, Patent Document 2), and an anisotropic powder in which the main phase thereof is a rhombohedral crystal structure that is a stable phase and called a $Th_2Zn_{17}$ type. The isotropic powder is obtained by a melt quenching method, etc.

The crystal constituting the Sm—Fe—N magnet decomposes at a temperature exceeding about 500° C. Therefore, the Sm—Fe—N magnet cannot be a sintered magnet requiring a temperature rise up to a temperature of around 1,000° C. during production and is used as a bonded magnet. In general, the bonded magnet is produced by mixing a magnet powder and a binder and molding the resultant compound by a compression molding machine, an injection molding machine, etc. Accordingly, the bonded magnet is inferior in the magnetic flux density to the sintered magnet by an amount corresponding to the presence of the binder or voids but has a feature of enabling it easy to obtain a bonded magnet that is small or thin or has a complicated shape. In addition, an isotropic Sm—Fe—N bonded magnet manufactured from a $TbCu_7$-type isotropic magnet powder has a low maximum energy product as compared with an anisotropic Sm—Fe—N bonded magnet manufactured from a $Th_2Zn_{17}$-type anisotropic magnet powder, but is advantageous in that a magnetic field need not be applied during molding and in turn, high production efficiency and high degree of freedom in magnetization pattern are provided. By taking advantage of these features of an isotropic bonded magnet and the above-described features of the Sm—Fe—N magnet (high in Curie temperature and resistant to oxidation and rusting), an isotropic Sm—Fe—N bonded magnet is used for a vehicle-directed motor, etc. which are used in severe environments.

Patent Document 1: JP-A-2002-057017
Patent Document 2: JP-T-2013-531359
Patent Document 3: JP-A-06-172936

Non-Patent Document 1: Ryo Omatsuzawa, Kimitoshi Murashige, and Takahiko Iriyama, "Structure and Magnetic Properties of SmFeN Prepared by Rapid-Quenching Method", DENKI-SEIKO (Electric Furnace Steel), Daido Steel Co., Ltd., Vol. 73, No. 4, pp. 235-242, published in October, 2002

SUMMARY OF THE INVENTION

The Sm—Fe—N isotropic ($TbCu_7$ type) magnet powder can be manufactured using a melt quenching method as described above. In the melt quenching method, a molten alloy obtained by heating and melting raw materials of an Sm—Fe powder is rapidly cooled by jetting it from an injection nozzle onto a rotating cooling body to manufacture an Sm—Fe powder. An Sm—Fe—N isotropic magnet powder is obtained by nitriding the Sm—Fe powder above. Here, as the crystal grain size of the obtained Sm—Fe—N isotropic magnet powder is smaller, a higher maximum energy product $(BH)_{max}$ is obtained due to the effect of exchange interaction, and therefore, more rapid cooling is required. In addition, for achieving more rapid cooling, the flow rate of the melt jetted from a hole of the injection nozzle needs to be reduced, and the hole diameter is preferably smaller. In practice, for example, an injection nozzle having an inner diameter of 2 mm or less is used. When an injection nozzle having such a small inner diameter is used, there arises a problem that, for example, the injection nozzle is clogged by minute inclusions, if present even slightly in the melt, such as samarium oxide ($Sm_2O_3$), and the yield decreases.

An object of the present invention is to provide an Sm—Fe—N magnet material affording a high yield at the time of production, and an Sm—Fe—N bonded magnet using the Sm—Fe—N magnet material.

Namely, the present invention relates to the following items (1) to (4).

(1) An Sm—Fe—N magnet material including:
from 7.0 to 12 at % of Sm;
from 0.1 to 1.5 at % of at least one element selected from the group consisting of Hf and Zr;
from 0.05 to 0.5 at % of C;
from 10 to 20 at % of N; and
from 0 to 35 at % of Co,
with the remainder being Fe and unavoidable impurities.

(2) The Sm—Fe—N magnet material according to (1), further including from 0.1 to 0.5 at % of Al.

(3) The Sm—Fe—N magnet material according to (1) or (2), further including from 0.15 to 0.5 at % of Si.

(4) An Sm—Fe—N bonded magnet including a powder of the Sm—Fe—N magnet material according to any one of (1) to (3) and a binder.

The Sm—Fe—N magnet material according to the present invention contains at least one element selected from the group consisting of Hf and Zr, and C (carbon), in addition to Sm, Fe, Co (an element for replacing a part of Fe as described above) and N, which are elements constituting the Sm—Fe—N magnet. Among these, Hf and Zr are known as an element capable of, when incorporated, increasing the ratio of a phase having a $TbCu_7$-type structure (see, for example, Patent Document 3). In the present invention, from 0.05 to 0.5 at % of C is incorporated into the Sm—Fe—N magnet material, and for the reasons described below, the injection nozzle hardly becomes clogged at the time of manufacture of an alloy powder, so that the yield can be increased.

As described above, when producing an Sm—Fe powder by the melt quenching method before nitriding, an Sm—Fe raw material is melted, and the melt is rapidly cooled by jetting it from an injection nozzle onto a rotating cooling body. At this time, minute inclusions such as samarium oxide ($Sm_2O_3$) in the melt are accumulated inside a small hole (for example, diameter: 2 mm) of the injection nozzle to cause clogging of the injection nozzle, thereby giving rise to a decrease in the yield. The present inventors have found that when C is added, clogging of the injection nozzle by such inclusions is suppressed and the yield is enhanced. As for the principle of suppression of clogging of the injection nozzle, it is presumed that the surface tension of the molten alloy is decreased by the addition of C, whereby minute inclusions such as $Sm_2O_3$ are hardly aggregated and easily dispersed in the melt, and the inclusions are consequently prevented from accumulating inside or around the hole of the injection nozzle. In this way, the addition of C suppresses clogging of the injection nozzle by minute inclusions such as $Sm_2O_3$, whereby the Sm—Fe—N magnet material can be produced in high yield.

In addition to the effects above, C also has an effect of bringing about deoxidization in the melt.

If the content of C in the Sm—Fe—N magnet material is too low, the surface tension of the melt cannot be reduced enough to provide an effect of making aggregation of inclusions difficult at the time of production. For this reason, in the Sm—Fe—N magnet material according to the present invention, the content of C is set to be 0.05 at % or more.

On the other hand, if the content of C in the Sm—Fe—N magnet material is too high, this causes a reduction in the magnetic properties such as residual magnetic flux density and maximum energy product. For this reason, in the Sm—Fe—N magnet material according to the present invention, the content of C is set to be 0.5 at % or less.

The Sm—Fe—N magnet material according to the present invention preferably further contains from 0.1 to 0.5 at % of Al. Thanks to this element, the magnetic flux density is prevented from reduction (thermal demagnetization) under a high temperature environment (for example, a temperature of about 200° C. that is achievable during use of an automotive motor) and is stabilized, and a magnet suitable for long-term use in a high temperature environment is obtained. Incidentally, even in the case of not positively adding Al, the Sm—Fe—N magnet material according to the present invention may contain less than 0.1 at % of Al as an unavoidable impurity.

The Sm—Fe—N magnet material according to the present invention preferably further contains from 0.15 to 0.5 at % of Si. Thanks to this element, similarly to the case of containing from 0.1 to 0.5 at % of Al, the magnetic flux density is stabilized by suppressing thermal demagnetization under a high temperature environment, and a magnet suitable for long-term use in a high temperature environment is obtained. Incidentally, even in the case of not positively adding Si, the Sm—Fe—N magnet material according to the present invention may contain less than 0.15 at % of Si. In addition, the Sm—Fe—N magnet material according to the present invention may contain both Si and Al each in an amount in the range described above or may contain only either one of Si and Al in an amount in the range described above.

The Sm—Fe—N magnet material according to the present invention may contain, as unavoidable impurities, O (oxygen) and H (hydrogen) each in an amount of up to 0.3 at %, and Cr (chromium), Ni (nickel), and Cu (copper) each in an amount of up to 0.1 at %.

As for the content of each element, the lower limit values of contents of C and Si are specified with accuracy down to, in percentage, the second decimal place, the upper limit values and lower limit values of the contents of Sm, N and Co are specified with double-digit accuracy, and the upper limit values of the contents of C and Si as well as the upper limit values and lower limit values of the contents of other elements are specified with accuracy down to the first decimal place. In the case when the content can be determined with higher accuracy than these numerical values, when the value rounded off at the place smaller by one digit than the effective digits is within the range above, the content satisfies the requirement of the present invention. For example, when the content of C is measured with accuracy down to the third decimal place and the measured value is 0.045 at %, the value "0.05 at %" obtained by rounding off the measured value at the third decimal place is within the range of 0.05 to 0.5 at % and therefore, satisfies the requirement regarding the content of C.

The Sm—Fe—N bonded magnet according to the present invention includes a powder of the Sm—Fe—N magnet material according to the present invention and a binder.

According to the present invention, an Sm—Fe—N magnet material providing a high yield at the time of production and an Sm—Fe—N bonded magnet using the Sm—Fe—N magnet material can be obtained.

DETAILED DESCRIPTION OF THE INVENTION

The embodiments of the Sm—Fe—N magnet material and Sm—Fe—N bonded magnet according to the present invention are described by referring to FIGS. 1A to 1E, FIG. 2 and FIG. 3.

The Sm—Fe—N magnet material of the present embodiment includes from 7.0 to 12 at % of Sm, from 0.1 to 1.5 at % of at least one element (hereinafter, referred to as "element T") selected from the group consisting of Hf and Zr, from 0.05 to 0.5 at % of C, from 10 to 20 at % of N, and from 0 to 35 at % of Co, with the remainder being Fe and unavoidable impurities. This Sm—Fe—N magnet material can be produced, for example, by the following method.

Figure 1A:
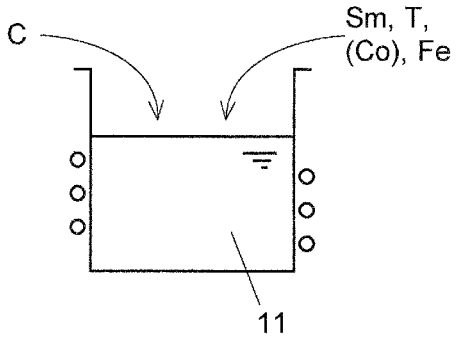
FIGS. 1A to 1E are diagrams illustrating the production method of the Sm—Fe—N magnet material that is one embodiment of the present invention.
Figure 1B:
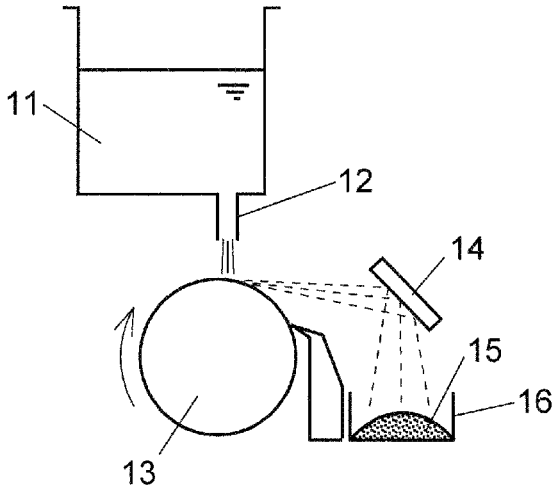
Figure 1C:
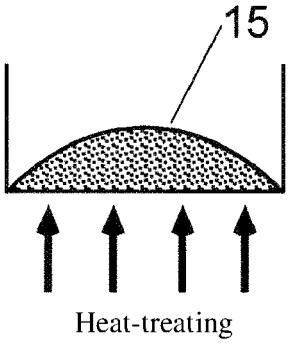
Figure 1D:
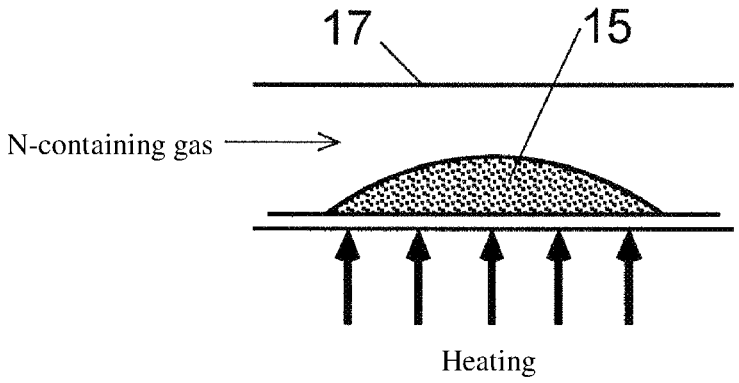

First, metal raw materials as simple substances of respective elements of Sm, the element T, Co (excluding the case where a Co content is 0 at %) and Fe, or an alloy raw material including two or more elements among the elements described above, and graphite as C are blended and melted by heating to afford the composition of an Sm—Fe powder before nitriding for an Sm—Fe—N magnet material to be manufactured, while taking into account the yield of each element, whereby a melt 11 is manufactured (FIG. 1A). Next, the melt 11 is jetted from an injection nozzle 12 onto the surface of a high-speed rotating roll 13, thereby being rapidly cooled, and a ribbon formed upon collision of the melt 11 with the roll 13 is pulverized by hitting it against a metal-made collision member 14 present on the path to a recovery vessel 16 and recovered as a powder 15 in the recovery vessel 16 (FIG. 1B). The powder 15 is heat-treated in an inert atmosphere at a temperature ranging from 700 to 800° C. (FIG. 1C), whereby an amorphous phase slightly contained before heat treatment is crystallized to enhance the crystallinity of the material. Incidentally, this operation is performed in order to achieve a higher coercive force after the subsequent nitriding treatment.

Figure 1E:
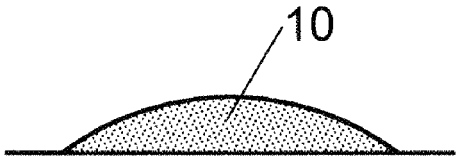

Thereafter, the powder 15 is heated in a gas containing molecules having nitrogen atom (FIG. 1D) to thereby nitride the powder 15. As such a gas, a mixed gas of ammonia and hydrogen may be suitably used. The heating temperature and pressure during the nitriding treatment vary depending on the gas used, but as an example, in the case of using a gas in which the volume ratio of ammonia and hydrogen is 1:3, the heating temperature is set to about 450° C. and as for the pressure, a substantially atmospheric pressure (slightly higher than the atmospheric pressure) is created by performing the treatment while passing the gas through, for example, a tube furnace 17. Here, the nitriding treatment time is adjusted to afford an N content in the powder of 10 to 20 at %. Incidentally, when the amount of the powder 15 is large, in order to achieve homogenization and improve the reaction efficiency, the nitriding is conducted while stirring the powder 15 in a rotary heating furnace. Through these operations, a powdered Sm—Fe—N magnet material 10 is obtained (FIG. 1E).

As described above, in general, the Sm—Fe—N magnet material includes a magnet material in which the main phase thereof is a $Th_2Zn_{17}$-type crystal structure, and a magnet material in which the main phase thereof is a $TbCu_7$-type crystal structure, but in the Sm—Fe—N magnet material 10 of the present embodiment, an isotropic Sm—Fe—N magnet material in which the main phase thereof is a $TbCu_7$-type crystal structure is obtained by incorporating from 0.1 to 1.5 at % of the element T and performing rapid cooling by the melt quenching method.

In the Sm—Fe—N magnet material 10 of the present embodiment, a melt 11 containing C is manufactured at its production and therefore, the surface tension of the melt 11 is reduced. Accordingly, minute inclusions such as $Sm_2O_3$ slightly produced in the melt 11 are hardly aggregated in the melt 11 and are dispersed throughout the melt 11. Consequently, inclusions can be prevented from accumulating inside or around the hole of the injection nozzle 12 and clogging the injection nozzle 12.

In the Sm—Fe—N magnet material 10 of the present embodiment, it is preferable to further contain from 0.15 to 0.5 at % of Si and/or from 0.1 to 0.5 at % of Al. Thanks to these elements, reduction in the magnetic flux density (thermal demagnetization) under a high temperature environment can be suppressed. Here, when both Si and Al are contained at the contents described above, thermal demagnetization can be more successfully suppressed.

The Sm—Fe—N bonded magnet of the present embodiment can be produced by mixing a binder with the powder, i.e., the Sm—Fe—N magnet material 10 manufactured by the method described above, and subjecting the mixture to compression molding or injection molding. As the binder, a thermosetting resin such as epoxy resin, and a thermoplastic resin such as nylon or polyphenylene sulfide (PPS) resin, can be used respectively for compression molding and for injection molding. For example, the Sm—Fe—N bonded magnet of the present embodiment is obtained by mixing 2 mass % of an epoxy resin with the powder, i.e., the Sm—Fe—N magnet material 10 of the present embodiment, and subjecting the mixture to compression molding.

EXAMPLES

In the following, the results of experiments of actually manufacturing an Sm—Fe—N magnet material and an Sm—Fe—N bonded magnet using the Sm—Fe—N magnet material are described. In this experiment, first, a powder of an Sm—Fe—N magnet material containing Sm, the element T (Zr, Hf), C, N, Co, Fe, Al and Si in the ratio shown in Table 1 was manufactured by the above-described method. In Examples 1 to 16, each of Sm, the element T, C, N, Co and Fe was contained at a content satisfying the requirement of the present invention, and each of Al and Si was contained at a content within the preferable addition requirement described above or within the allowable range as an impurity. Of these, in Examples 13 to 16, the content of Al was within the range of 0.1 to 0.5 at % which was the preferable addition requirement described above. In Examples 2 to 5 and 16, the content of Si was within the range of 0.15 to 0.5 at % which was the preferable addition requirement described above. On the other hand, in Comparative Examples 1 to 4, the content of C was smaller than the range of 0.05 to 0.5 at % which was the requirement of the present invention (indicated as "lack of C" in Table 1). In addition, in Comparative Example 5, the content of C was larger than the requirement of the present invention (indicated as "excess of C" in Table 1).

At the manufacture of these powders before nitriding for the Sm—Fe—N magnet material by the melt quenching method, out of raw materials used, the amounts of raw materials which could be recovered as a powder of the Sm—Fe material were determined as a mass ratio and shown in mass percentage as the recovery ratio (yield) in Table 1. If inclusions accumulate inside or around the hole of the injection nozzle 12 in the process of manufacture and the injection nozzle 12 is clogged, the melt 11 cannot be jetted from the injection nozzle 12 and consequently, the recovery ratio decreases.

After adding 2 mass % of epoxy resin to each of the powders of Sm—Fe—N magnet materials of Examples 1 to 16 and Comparative Examples 1 to 5 obtained above and subjecting the mixture to compression molding, a hardening treatment was performed to manufacture an Sm—Fe—N bonded magnet. With respect to each Sm—Fe—N bonded magnet manufactured, the residual magnetic flux density Br, the coercive force ${}_iH_c$, and the maximum energy product $(BH)_{max}$ were measured.

The composition and recovery ratio of the manufactured Sm—Fe—N magnet material and the results of measuring the magnetic properties of the Sm—Fe—N bonded magnet are shown in Table 1.

TABLE 1

| | Composition of Sm—Fe—N Magnet Material [at %] (*remainder: Fe) | | | | | | | | | Magnetic Properties | | | |
|---|---|---|---|---|---|---|---|---|---|---|---|---|---|
| | | Element T | | | | | | | Recovery | $B_r$ | $_iH_c$ | $(BH)_{max}$ | |
| | Sm | Zr | Hf | C | N | Co | Al | Si | ratio [%] | [kG] | [kOe] | [MGOe] | Remarks |
| Example 1 | 7.34 | 1.04 | | 0.06 | 13.5 | 3.82 | 0.03 | 0.06 | 82 | 7.95 | 9.42 | 13.3 | |
| Example 2 | 7.25 | 1.03 | | 0.07 | 13.2 | 3.81 | 0.02 | 0.31 | 88 | 8.03 | 9.35 | 13.5 | Si content: 0.15-0.5 at % |
| Example 3 | 7.34 | 1.05 | | 0.08 | 13.5 | 3.80 | 0.04 | 0.16 | 83 | 8.05 | 9.42 | 13.3 | Si content: 0.15-0.5 at % |
| Example 4 | 7.32 | 0.96 | | 0.09 | 13.2 | 3.68 | 0.02 | 0.17 | 84 | 8.15 | 9.40 | 13.2 | Si content: 0.15-0.5 at % |
| Example 5 | 7.39 | 1.08 | | 0.09 | 13.1 | 3.86 | 0.04 | 0.18 | 85 | 8.05 | 9.45 | 13.4 | Si content: 0.15-0.5 at % |
| Example 6 | 7.34 | 1.09 | | 0.09 | 13.5 | 3.81 | 0.02 | 0.08 | 88 | 8.03 | 9.34 | 13.1 | |
| Example 7 | 7.40 | 0.95 | | 0.53 | 12.9 | 3.75 | 0.03 | 0.1 | 95 | 7.90 | 9.53 | 13.2 | |
| Example 8 | 7.35 | 1.03 | | 0.11 | 13.4 | 3.81 | 0.04 | 0.13 | 91 | 8.07 | 9.20 | 13.3 | |
| Example 9 | 7.31 | | 1.35 | 0.13 | 13.5 | 3.73 | 0.03 | 0.08 | 92 | 8.05 | 9.56 | 13.1 | |
| Example 10 | 7.37 | 1.07 | | 0.43 | 13.3 | 3.91 | 0.02 | 0.07 | 95 | 8.10 | 9.45 | 13.4 | |
| Example 11 | 7.42 | 1.02 | | 0.33 | 13.7 | 3.76 | 0.04 | 0.03 | 96 | 7.94 | 9.43 | 13.3 | |
| Example 12 | 7.37 | 0.96 | | 0.19 | 13.2 | 3.75 | 0.02 | 0.04 | 94 | 8.04 | 9.36 | 13.3 | |
| Example 13 | 7.45 | 1.11 | | 0.32 | 13.4 | 3.83 | 0.13 | 0.13 | 97 | 8.05 | 9.47 | 13.4 | Al content: 0.1-0.5 at % |
| Example 14 | 7.42 | 1.21 | | 0.12 | 13.3 | 3.75 | 0.38 | 0.11 | 88 | 8.03 | 9.50 | 13.2 | Al content: 0.1-0.5 at % |
| Example 15 | 7.43 | 1.02 | | 0.12 | 13.4 | 3.79 | 0.26 | 0.06 | 92 | 8.06 | 9.41 | 13.3 | Al content: 0.1-0.5 at % |
| Example 16 | 7.36 | 1.14 | | 0.19 | 13.3 | 3.81 | 0.32 | 0.15 | 93 | 8.01 | 9.30 | 13.4 | Si content: 0.15-0.5 at % Al content: 0.1-0.5 at % |
| Comp. Ex. 1 | 7.32 | 1.02 | | 0.03 | 13.2 | 3.79 | 0.03 | 0.05 | 70 | 8.03 | 9.45 | 13.2 | lack of C, recovery ratio: small |
| Comp. Ex. 2 | 7.28 | 1.12 | | 0.02 | 13.4 | 3.81 | 0.03 | 0.06 | 65 | 8.14 | 9.53 | 13.4 | lack of C, recovery ratio: small |
| Comp. Ex. 3 | 7.34 | 1.04 | | 0.03 | 13.3 | 3.82 | 0.03 | 0.32 | 72 | 8.04 | 9.39 | 13.2 | lack of C, recovery ratio: small |
| Comp. Ex. 4 | 7.22 | 0.98 | | 0.04 | 13.2 | 3.81 | 0.04 | 0.13 | 71 | 8.03 | 9.43 | 13.3 | lack of C, recovery ratio: small |
| Comp. Ex. 5 | 7.32 | 1.02 | | 0.63 | 13.1 | 3.83 | 0.04 | 0.05 | 95 | 7.50 | 9.44 | 12.1 | excess of C, $B_r$ and $(BH)_{max}$: small |

Figure 2:
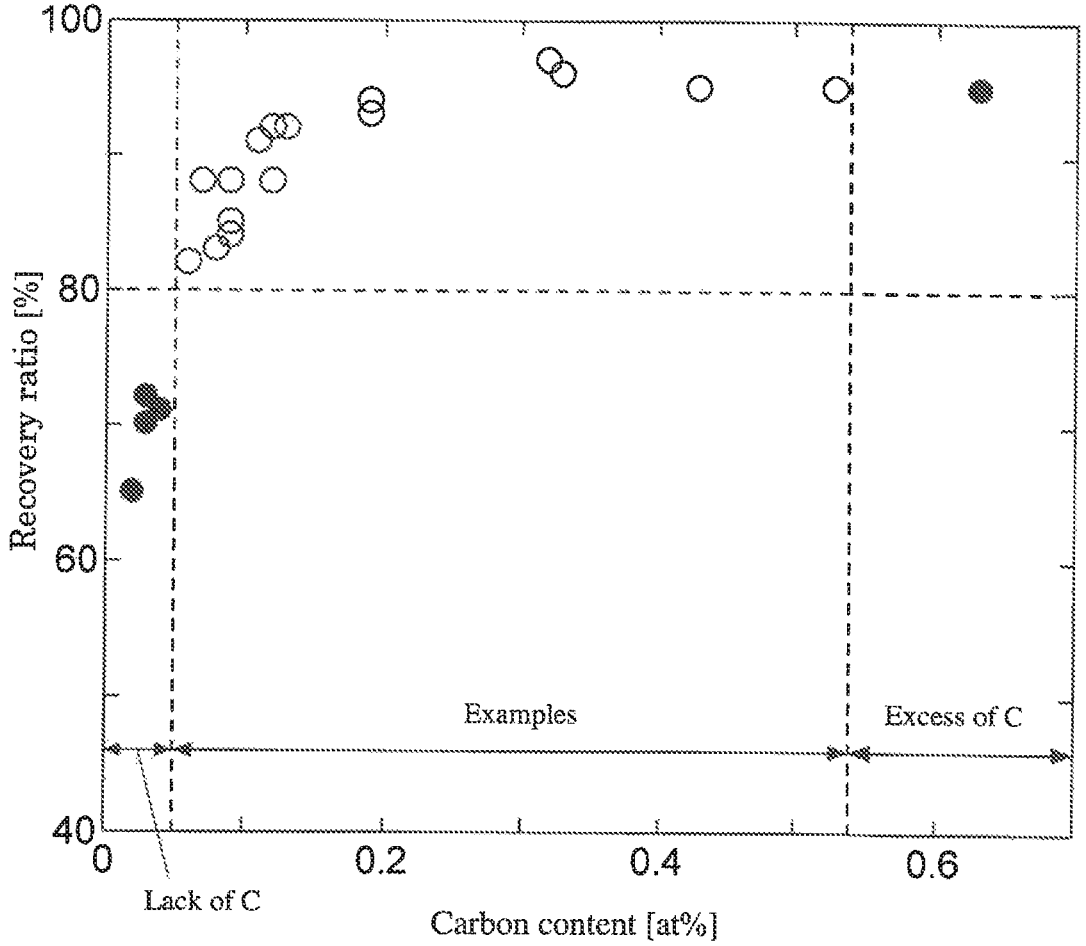
FIG. 2 is a graph illustrating the relationship of the content of C in the samples of Examples and Comparative Examples with the recovery ratio obtained in experiments.

As seen in Table 1 and FIG. 2, in all of Examples 1 to 16 where the content of C was within the range of the present invention and in Comparative Example 5 where the content of C was higher than that, the powder of the Sm—Fe—N magnet material could be obtained at a recovery ratio on the 90% or 80% level, while in Comparative Examples 1 to 4 where the content of C was lower than the range of the present invention, the recovery ratio remained at the 60% or 70% level. From these recovery ratio data, it was confirmed that the recovery ratio can be increased by the addition of C to the Sm—Fe—N magnet material and in turn, the yield is enhanced.

Figure 3:
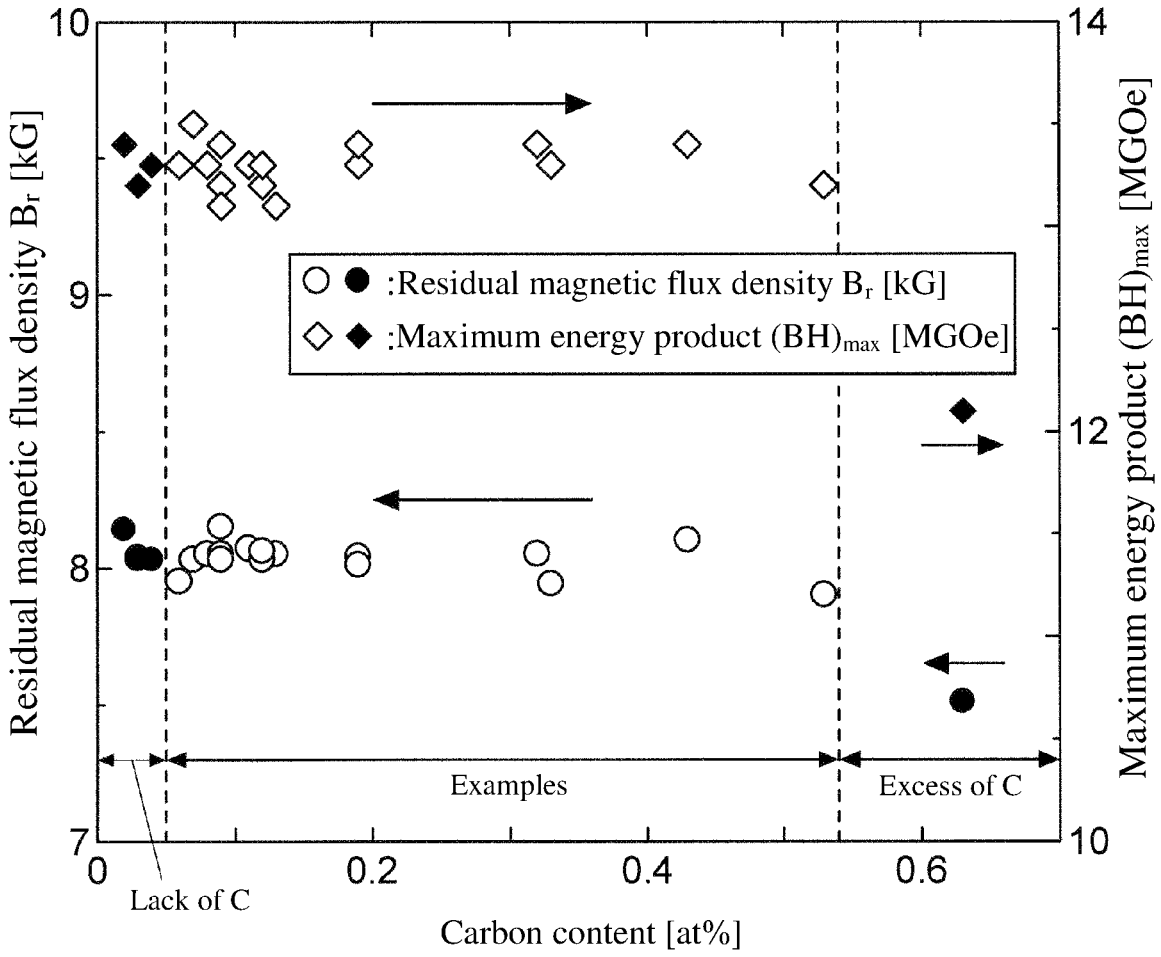
FIG. 3 is a graph illustrating the relationship of the content of C in the samples of Examples and Comparative Examples with the residual magnetic flux density $B_r$ and maximum energy product $(BH)_{max}$ obtained in experiments.

On the other hand, among magnetic properties of the Sm—Fe—N bonded magnet manufactured, the residual magnetic flux density $B_r$ and the maximum energy product $(BH)_{max}$ were, as seen in Table 1 and FIG. 3, lower in Comparative Example 5 where the content of C was higher than the range of the present invention, as compared with Examples 1 to 16. Accordingly, it is appropriate to set the content of C in the Sm—Fe—N magnet material to be from 0.05 to 0.5 at % which is the range of the present invention. Incidentally, as to the coercive force $_iH_c$, there was no significant difference between Examples and Comparative Examples.

Next, with respect to Examples 3 to 5 where the content of Si is from 0.15 to 0.5 at %, Examples 14 and 15 where the content of Al is from 0.1 to 0.5 at %, Example 16 where the contents of both Si and Al are within the respective ranges described above, and Example 1 and Comparative Example 1 where the contents of both Si and Al are smaller than the respective ranges described above, the results of measuring the irreversible demagnetizing factor are described below. At the beginning, the irreversible demagnetizing factor is described. In general, a magnet after being magnetized decreases in the magnetic flux density as the temperature rises. When the temperature once rises and then drops to room temperature, the magnetic flux density may be partially recovered but is not completely recovered. Such a decrease in the magnetic flux density caused upon heating from room temperature is referred to as "thermal demagnetization". Out of thermal demagnetization, the portion in which the magnetic flux density recovers when returning to room temperature is referred to as "reversible demagnetization", and the portion in which the magnetic flux density does not recover is referred to as "irreversible demagnetization". In this experiment, the Sm—Fe—N bonded magnets of Examples 1, 3 to 5 and 14 to 16 and Comparative Example 1 were magnetized; the magnetic flux $\phi_0$ of each of these Sm—Fe—N bonded magnets was measured; after holding in a furnace at 120° C. for the later-described holding time and then cooling to room temperature, the magnetic flux $\phi_T$ of each of the Sm—Fe—N bonded magnets was measured; and the irreversible demagnetizing factor was determined according to $(\phi T-\phi_0)/\phi_0)\times 100=\Delta M_T$.

Here, an experiment employing a holding time of 1 hour and an experiment employing a holding time of 2,000 hours were performed. In general, the magnetic flux of a magnet greatly decreases with a temperature rise and slowly decreases during a period of holding a predetermined temperature after reaching the temperature. A magnet is usually selected by anticipating in advance a large decrease of the magnetic flux at the initial stage and therefore, in order to obtain stable properties at high temperatures, the decrease rate at the time of slow decrease of the magnetic flux during the period of maintaining a predetermined temperature after a large decrease at the initial stage is preferably as small as possible. Accordingly, in this experiment, $(\Delta M_{2000}-\Delta M_1)$ determined by subtracting the demagnetizing factor $\Delta M_1$ (this is referred to as initial demagnetizing factor) obtained in the experiment employing a holding time of 1 hour from the demagnetizing factor $\Delta M_{2000}$ obtained in the experiment employing a holding time of 2,000 hours was evaluated. Although $(\Delta M_{2000}-\Delta M_1)$ takes a negative value due to the definition thereof, a smaller absolute value means that stable properties are obtained at high temperatures.

The experimental results of the irreversible demagnetizing factor are shown in Table 2.

TABLE 2

| | Content of Al [at %] | Content of Si [at %] | Irreversible Demagnetizing Factor: Initial Demagnetizing Factor $\Delta M_1$ [%] | Irreversible Demagnetizing Factor: Demagnetizing Factor in 2000 Hours $\Delta M_{2000}$ [%] | Irreversible Demagnetizing Factor: $\Delta M_{2000} - \Delta M_1$ [%] |
|---|---|---|---|---|---|
| Example 3 | 0.04 | 0.16 | −6.71 | −8.89 | −2.18 |
| Example 4 | 0.02 | 0.17 | −6.60 | −8.76 | −2.16 |
| Example 5 | 0.04 | 0.18 | −6.66 | −8.77 | −2.11 |
| Example 14 | 0.38 | 0.11 | −6.63 | −8.71 | −2.08 |
| Example 15 | 0.26 | 0.06 | −6.74 | −8.93 | −2.19 |
| Example 16 | 0.32 | 0.15 | −6.58 | −8.52 | −1.94 |
| Example 1 | 0.03 | 0.06 | −6.78 | −9.16 | −2.38 |
| Comparative Example 1 | 0.03 | 0.05 | −6.82 | −9.12 | −2.30 |

These results reveal that in Examples 3 to 5 and 14 to 16 where the content of Si was within the range of 0.15 to 0.5 at % and/or the content of Al was within the range of 0.1 to 0.5 at %, the absolute value of ($\Delta M_{2000}-\Delta M_1$) was smaller as compared with Example 1 and Comparative Example 1 where the contents of Si and/or Al were lower than the ranges described above, and stable properties were obtained at high temperatures. Incidentally, in order to obtain stable properties at high temperatures, the irreversible demagnetizing factor ($\Delta M_{2000}-\Delta M_1$) is suitably from −2.2% to −1.8% and falls within this range in all of Examples 3 to 5 and 14 to 16. In order to more successfully obtain stable properties at high temperatures, the irreversible demagnetizing factor ($\Delta M_{2000}-\Delta M_1$) is suitably from −2.0% to −1.8% and falls within this range in Example 16.

The present invention is not limited to the above-described embodiments, and changes can be made therein within the scope of the gist of the present invention.

The present application is based on Japanese patent application No. 2018-034276 filed on Feb. 28, 2018, and the contents of which are incorporated herein by reference.

DESCRIPTION OF REFERENCE NUMERALS AND SIGNS

10: Sm—Fe—N magnet material
11: Melt
12: Injection nozzle
13: Roll
14: Collision member
15: Powder
16: Recovery vessel
17: Tube furnace

What is claimed is:

1. An Sm—Fe—N magnet material, comprising:
from 7.0 at % to 12 at % of Sm;
from 0.1 at % to 1.5 at % of at least one element selected from the group consisting of Hf and Zr;
from 0.05 at % to 0.09 at % of C;
from 10 at % to 20 at % of N;
from 0 at % to 35 at % of Co; and
at least one element selected from the group consisting of Al in a range from 0.1 at % to 0.5 at % and Si in a range from 0.15 at % to 0.5 at %,
with a remainder being Fe and unavoidable impurities,
wherein, when the Sm—Fe—N magnet material is maintained for 2,000 hours at 120° C. in atmosphere, an absolute value of a reduction rate from an initial demagnetizing factor is in a range from 1.8% to 2.2%, and
wherein the Sm—Fe—N bonded magnet has a residual magnetic flux density (Br) of $B_r \geq 8.00$ kG.

2. An Sm—Fe—N bonded magnet comprising a powder of the Sm—Fe—N magnet material according to claim 1 and a binder.

3. The Sm—Fe—N magnet material according to claim 1, wherein, when the Sm—Fe—N magnet material is maintained for 2,000 hours at 120° C., an irreversible demagnetizing factor is in a range from 1.8% to 2.0%.

4. The Sm—Fe—N magnet material according to claim 1, wherein the Sm—Fe—N magnet material includes Zr in a range from 0.1 at % to 1.5 at %.

5. The Sm—Fe—N magnet material according to claim 1, wherein a content of Co in the Sm—Fe—N magnet material is more than 0 at %.

6. An Sm—Fe—N magnet material, consisting of:
from 7.0 at % to 12 at % of Sm;
from 0.1 at % to 1.5 at % of at least one element selected from the group consisting of Hf and Zr;
from 0.05 at % to 0.09 at % of C;
from 10 at % to 20 at % of N;
from 0 at % to 35 at % of Co; and
at least one element selected from the group consisting of Al in a range from 0.1 at % to 0.5 at % and Si in a range from 0.15 at % to 0.5 at %,
with a remainder being Fe and unavoidable impurities,
wherein the Sm—Fe—N bonded magnet has a residual magnetic flux density ($B_r$) of $B_r \geq 8.00$ kG.

7. The Sm—Fe—N magnet material according to claim 6, wherein from 0.1 at % to 0.5 at % of Al is provided.

8. The Sm—Fe—N magnet material according to claim 7, wherein from 0.15 at % to 0.5 at % of Si is provided.

9. The Sm—Fe—N magnet material according to claim 6, wherein from 0.15 at % to 0.5 at % of Si is provided.

10. The Sm—Fe—N magnet material according to claim 6, wherein, when the Sm—Fe—N magnet material is maintained for 2,000 hours at 120° C., an irreversible demagnetizing factor is in a range from 1.8% to 2.2%.

11. The Sm—Fe—N, magnet material according to claim 6, wherein, when the Sm—Fe—N magnet material is maintained for 2,000 hours at 120° C., an irreversible demagnetizing factor is in a range from 1.8% to 2.0%.

12. The Sm—Fe—N magnet material according to claim 6, wherein the Sm—Fe—N magnet material includes Zr in a range from 0.1 at % to 1.5 at %.

13. The Sm—Fe—N magnet material according to claim 6, wherein a content of Co in the Sm—Fe—N magnet material is more than 0 at %.

14. An Sm—Fe—N magnet material, comprising:
from 7.0 at % to 12 at % of Sm;
from 0.1 at % to 1.5 at % of at least one element selected from the group consisting of Hf and Zr;
from 0.05 at % to 0.09 at % of C;
from 10 at % to 20 at % of N;
from 0 at % to 35 at % of Co;
from 0.1 at % to 0.5 at % of Al; and,
from 0.15 at % to 0.5 at % of Si,
with a remainder being Fe and unavoidable impurities,
wherein, when the Sm—Fe—N magnet material is maintained for 2,000 hours at 120° C. in atmosphere, an absolute value of a reduction rate from an initial demagnetizing factor is in a range from 1.8% to 2.2%.

* * * * *